US011193740B2

(12) United States Patent
Gordon

(10) Patent No.: US 11,193,740 B2
(45) Date of Patent: Dec. 7, 2021

(54) AXIALLY-CENTERED EXTERNAL DETONATING CORD PACKAGED PRODUCT

(71) Applicant: Dyno Nobel Inc., Salt Lake City, UT (US)

(72) Inventor: David Lynn Gordon, West Jordan, UT (US)

(73) Assignee: Dyno Nobel Inc., Salt Lake City, UT (US)

( * ) Notice: Subject to any disclaimer, the term of this patent is extended or adjusted under 35 U.S.C. 154(b) by 0 days.

(21) Appl. No.: 16/811,938

(22) Filed: Mar. 6, 2020

(65) Prior Publication Data

US 2020/0284559 A1 Sep. 10, 2020

Related U.S. Application Data

(60) Provisional application No. 62/815,884, filed on Mar. 8, 2019.

(51) Int. Cl.

| | |
|---|---|
| ***F42B 3/087*** | (2006.01) |
| ***C06C 5/04*** | (2006.01) |
| *F42B 1/02* | (2006.01) |

(52) U.S. Cl.

CPC ..... *F42B 3/087* (2013.01); *C06C 5/04* (2013.01); *F42B 1/02* (2013.01)

(58) Field of Classification Search

CPC .. F42B 3/087; F42B 3/093; F42B 3/02; F42B 1/00; F42B 1/028; F42B 1/036; F42B 1/04

See application file for complete search history.

(56) References Cited

U.S. PATENT DOCUMENTS

| | | | | | |
|---|---|---|---|---|---|
| 526,501 | A * | 9/1894 | Plummer | B65D 31/12 | 383/40 |
| 1,567,991 | A * | 12/1925 | George | F42B 3/087 | 102/331 |
| 2,969,101 | A * | 1/1961 | White | F42B 3/087 | 383/113 |
| 3,049,079 | A * | 8/1962 | Eilo | F42D 1/24 | 102/324 |
| 3,064,572 | A * | 11/1962 | Aitchison | F42B 3/087 | 102/313 |
| 3,114,316 | A * | 12/1963 | Littleton | F41H 11/14 | 102/403 |
| 3,349,705 | A * | 10/1967 | Wilson | F42B 3/087 | 102/314 |
| 3,534,685 | A | 10/1970 | Romocki et al. | | |

(Continued)

FOREIGN PATENT DOCUMENTS

WO 2007099359 9/2007

OTHER PUBLICATIONS

International Search Report and Written Opinion dated Jun. 30, 2020 for PCT/US2020/021539.

*Primary Examiner* — Derrick R Morgan
(74) *Attorney, Agent, or Firm* — Stoel Rives LLP

(57) ABSTRACT

A packaged explosive product may include packaging film, explosive product, and a detonating cord. The packaging film may form one or more casings that contain the explosive product. The packaging film and explosive product form a charge. The detonating cord may be positioned external the one or more casings in relation to the explosive product while being positioned axially internal in relation to the one or more charges.

21 Claims, 9 Drawing Sheets

(56) References Cited

U.S. PATENT DOCUMENTS 3,538,852 A * 11/1970 Hoyl ..... F42B 3/02 102/504
3,837,279 A * 9/1974 Cooke, Jr. ..... F42B 3/087 102/317
4,034,672 A * 7/1977 Eckels ..... F42B 3/093 102/313
4,052,939 A * 10/1977 Simmons ..... F42B 3/087 102/323
4,090,447 A * 5/1978 Johnsen ..... F42B 3/08 102/313
4,205,611 A * 6/1980 Slawinski ..... B32B 27/08 102/324
4,282,812 A * 8/1981 Forgey ..... F42B 3/26 102/318
4,286,520 A 9/1981 Davis
4,495,867 A 1/1985 Mitchell et al.
4,649,825 A 3/1987 Quick et al.
4,872,408 A * 10/1989 Marz ..... F42B 3/087 102/324
5,798,477 A 8/1998 Givens et al.
5,959,233 A * 9/1999 Garcia ..... F41H 11/14 89/1.13
6,182,573 B1 * 2/2001 Richards ..... F41H 11/14 102/275.12
6,227,095 B1 * 5/2001 Woodall ..... B63G 7/02 102/318
6,321,630 B1 * 11/2001 Woodall ..... F41H 11/14 102/403
6,324,957 B1 12/2001 Hendershot et al.
6,508,177 B1 1/2003 Badger et al.
7,536,956 B2 5/2009 Sammons et al.
7,819,063 B1 * 10/2010 Lehman ..... F42D 3/00 102/301
8,267,013 B2 * 9/2012 Moore ..... F42B 3/087 102/331
8,904,934 B1 12/2014 Scheid
8,904,937 B2 12/2014 Mangolds et al.
9,115,963 B2 * 8/2015 Most ..... F42D 1/04
9,194,667 B2 11/2015 Chartier et al.
10,000,994 B1 6/2018 Sites
10,947,169 B2 * 3/2021 Brown ..... C06C 5/04
2011/0197779 A1 * 8/2011 Moore ..... F42D 1/12 102/331
2020/0284559 A1 * 9/2020 Gordon ..... C06C 5/04

* cited by examiner

AXIALLY-CENTERED EXTERNAL DETONATING CORD PACKAGED PRODUCT

CROSS-REFERENCE TO RELATED APPLICATIONS

This application claims the benefit of U.S. Provisional Patent Application No. 62/815,884, entitled "AXIALLY-CENTERED EXTERNAL DETONATING CORD PACKAGED PRODUCT", filed Mar. 8, 2019, the contents of which are hereby incorporated herein by reference in their entirety.

TECHNICAL FIELD

The present disclosure relates generally to explosives. More specifically, the present disclosure relates to packaged explosives.

BRIEF DESCRIPTION OF THE DRAWINGS

The embodiments disclosed herein will become more fully apparent from the following description and appended claims, taken in conjunction with the accompanying drawings. The drawings depict primarily generalized embodiments, which embodiments will be described with additional specificity and detail in connection with the drawings in which:

DETAILED DESCRIPTION

Figure 1A:
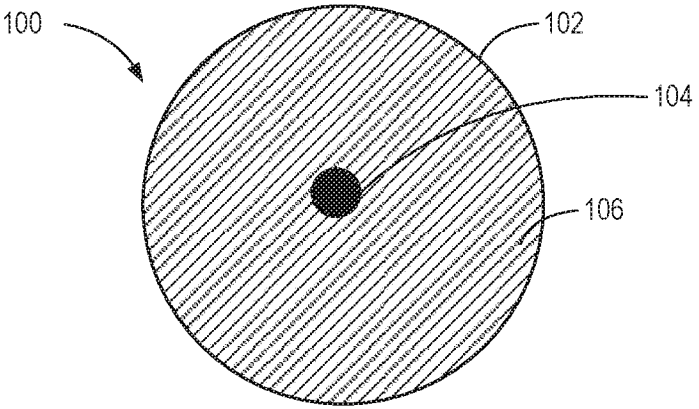
FIG. 1A illustrates a cross-sectional view of a packaged explosive with an internal detonating cord.

Explosives are commonly used in the mining, quarrying, and excavation industries for breaking rocks and ore. Generally, a hole, referred to as a "blasthole," is drilled in a surface, such as the ground. Packaged explosives (e.g., emulsion explosives and watergel explosives) may then be lowered into the blasthole. A multitude of holes are usually grouped into a blast pattern, intended to be initiated sequentially in a single blast event. The holes along the perimeter not adjacent a free face (i.e. the blast pattern perimeter bounded by rock and not by air) are often spaced very close together, and are loaded with a light load of explosive material intended to create a "pre-split" or crack between the holes, to aid in preventing rock breakage beyond the desired perimeter boundary. These pre-split or wall control boreholes are typically loaded with a string of explosives of a diameter considerably smaller than the borehole diameter, so as to uncouple or separate the explosive from the borehole wall. To ensure reliable detonation through the entire string of explosives, the string may be primarily initiated with an enclosed or attached string of detonating cord powerful enough to initiate the main explosive material.

Emulsion explosives are mixtures of oxidizers and fuel, wherein during high-shear mixing, small droplets of oxidizer solutions are emulsified as the discontinuous phase with the fuel solution becoming a continuous phase. Emulsions are stabilized with the use of emulsifiers which allow these water-in-oil type emulsions to form. In general, the emulsion needs to be "sensitized" in order for the emulsion to detonate successfully. Sensitizing is often accomplished by introducing small voids into the emulsion. These voids act as hot spots for propagating detonation. These voids may be introduced by a density reducing agent, such as by blowing a gas into the emulsion and thereby forming gas bubbles, by adding solid microspheres or other porous media, by entraining air while mixing solid components into the emulsion, and/or by injecting chemical gassing agents into the emulsion which react and thereby form small, well-distributed gas bubbles.

Any emulsion explosive known in the art may be used. Examples of the fuel phase include, but are not limited to, liquid fuels such as fuel oil, diesel oil, distillate, furnace oil, kerosene, gasoline, and naphtha; waxes such as microcrystalline wax, paraffin wax, and slack wax; oils such as paraffin oils, benzene, toluene, and xylene oils, asphaltic materials, polymeric oils such as the low molecular weight polymers of olefins, animal oils, such as fish oils, and other mineral, hydrocarbon or fatty oils; and mixtures thereof. Any fuel phase known in the art and compatible with the oxidizer phase and an emulsifier, if present, may be used.

Examples of the oxidizer phase include, but are not limited to, oxygen-releasing salts. Examples of oxygen-releasing salts include, but are not limited to, alkali and alkaline earth metal nitrates, alkali and alkaline earth metal chlorates, alkali and alkaline earth metal perchlorates, ammonium nitrate, ammonium chlorate, ammonium perchlorate, and mixtures thereof, such as a mixture of ammonium nitrate and sodium or calcium nitrates. Any oxidizer phase known in the art and compatible with the fuel phase and an emulsifier, if present, may be used. The oxidizer phase may be dissolved in an aqueous solution, resulting in an emulsion explosive known in the art as a "water-in-oil" emulsion. The oxidizer phase may not be dissolved in an aqueous solution, resulting in an emulsion explosive known in the art as a "melt-in-oil" emulsion.

In some embodiments, the emulsion explosive further comprises an emulsifier. Examples of emulsifiers include, but are not limited to, emulsifiers based on the reaction products of poly[alk(en)yl] succinic anhydrides and alkylamines, including the polyisobutylene succinic anhydride (PiBSA) derivatives of alkanolamines. Additional examples of emulsifiers include, but are not limited to, alcohol alkoxylates, phenol alkoxylates, poly(oxyalkylene)glycols, poly (oxyalkylene) fatty acid esters, amine alkoxylates, fatty acid esters of sorbitol and glycerol, fatty acid salts, sorbitan esters, poly(oxyalkylene) sorbitan esters, fatty amine alkoxylates, poly(oxyalkylene) glycol esters, fatty acid amines, fatty acid amide alkoxylates, fatty amines, quaternary amines, alkyloxazolines, alkenyloxazolines, imidazolines, alkylsulphonates, alkylsulphosuccinates, alkylarylsulphonates, alkylphosphates, alkenylphosphates, phosphate esters, lecithin, copolymers of poly(oxyalkylene)glycol and poly(12-hydroxystearic) acid, 2-alkyl and 2-alkenyl-4,4'-bis (hydroxymethyl)oxazoline, sorbitan mono-oleate, sorbitan sesquioleate, 2-oleyl-4,4'bis(hydroxymethyl)oxazoline, and mixtures thereof. Any emulsifier known in the art and compatible with the fuel phase and the oxidizer phase may be used.

Watergel also referred to as slurry explosives generally have a continuous aqueous phase of inorganic oxidizer salt dissolved in water, fuel(s) dispersed or dissolved throughout the phase, and thickening and crosslinking agents to impart desired rheology. The explosives also generally require a density reducing agent for imparting adequate detonation sensitivity. Such density reducing agents are air bubbles, which can be entrained during mixing of ingredients; gas bubbles produced in-situ chemically; small, hollow, dispersed glass or plastic spheres; and other porous, gas-entraining solids such as expanded perlite.

For blastholes, depending upon the length or depth, detonators may be placed at the end, also referred to as the "toe," of the blasthole and at the beginning of the emulsion explosives. Often, in such situations, the top of the blasthole will not be filled with explosives, but will be filled with an inert material, referred to as "stemming," to try to keep the force of an explosion within the material surrounding the blasthole, rather than allowing explosive gases and energy to escape out of the top of the blasthole.

It will be readily understood that the components of the embodiments as generally described below and illustrated in the Figures herein could be arranged and designed in a wide variety of different configurations. For instance, the steps of a method do not necessarily need to be executed in any specific order, or even sequentially, nor do the steps need to be executed only once. Thus, the following more detailed description of various embodiments, as described below and represented in the Figures, is not intended to limit the scope of the disclosure, but is merely representative of various embodiments. While the various aspects of the embodiments are presented in drawings, the drawings are not necessarily drawn to scale unless specifically indicated.

The phrases "operably connected to," "connected to," "operably coupled to," and "coupled to" refer to any form of interaction between two or more entities, including mechanical, electrical, magnetic, electromagnetic, fluidic, and thermal interaction. Two entities may interact with each other even though they are not in direct contact with each other. For example, two entities may interact with each other indirectly through an intermediate entity.

"Axially-centered" or "axially internal" refers to a position within a boundary formed from one or more packaged explosive products. In some embodiments, an axially-centered detonating cord may be located at or near an axis along a length (the longitudinal axis) of a packaged explosive product, such as a central axis or close there to. For example, a packaged explosive product may be underfilled or partially filled and wrapped around the detonating cord and secured in place to allow the detonating cord to be located towards the axial center of the packaged explosive product. As another example, multiple packaged explosives may be arranged around the detonating cord and secured in place such that the detonating cord is located towards the axial center of the combined packaged explosive products. Thus, an axially-centered detonating cord may be encased or confined within the one or more packaged explosive products without being in the emulsion or watergel of the one or more packaged explosive products.

"Charge" or "explosive charge" is used herein to refer to an explosive product (e.g., emulsion or watergel) encased in a packaging plastic film. A chub is a single charge formed by clipping or crimping the ends of the charge. A packaged explosive may be divided into a series of chubs forming a continuous string of explosive charges.

Much of the disclosure herein refers to emulsion explosives and watergel explosives. The disclosure herein regarding emulsion explosives is applicable to other explosives such as watergel explosives. The disclosure herein regarding watergel explosives is applicable to other explosives such as emulsion explosives. Likewise, the disclosure herein regarding explosives generally is applicable to emulsion explosives and watergel explosives. Emulsion explosives are one example of an explosive contemplated by this disclosure. Other examples of explosives are ANFO, heavy ANFO, and ANFO or ammonium nitrate (AN) prill blends with emulsion explosives. The systems and methods disclosed herein are applicable to a variety of explosives. These explosives can be any fluid, solid or a combination that has a moldable rheology and does not retain its own shape. Explosive can be cap sensitive or booster sensitive with the strength of the detonating cord selected appropriately for the sensitivity of the explosive.

Figure 1B:
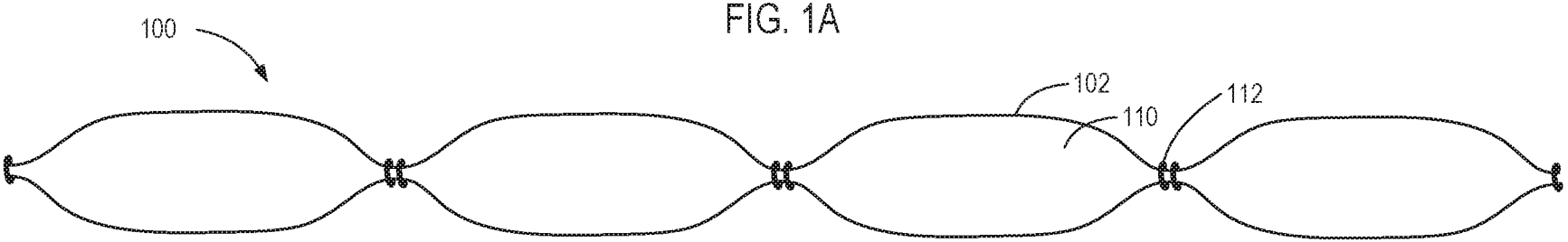
FIG. 1B illustrates a side view of a packaged explosive with an internal detonating cord.
Figure 1C:
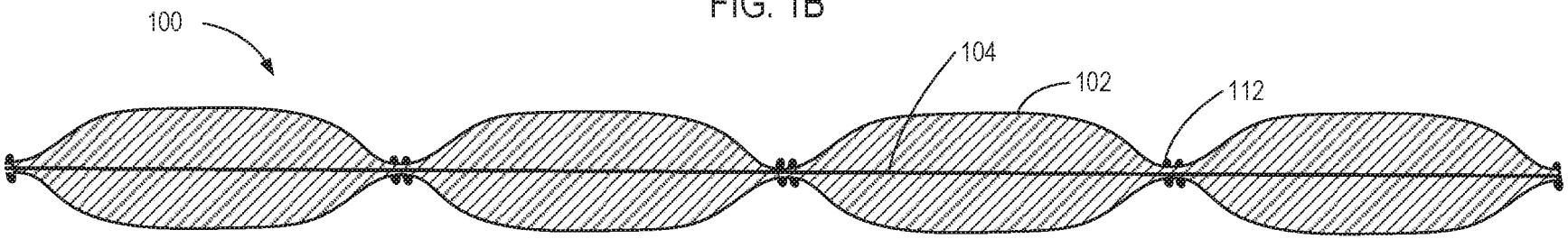
FIG. 1C illustrates a cross-sectional side view of a packaged explosive with an internal detonating cord.

Turning now to the Figures, FIGS. 1A-1C illustrate various views of a packaged explosive 100 with an internal detonating cord 104. Specifically, FIG. 1A illustrates a cross-sectional view of a packaged explosive 100 with an internal detonating cord 104. The packaged explosive 100 includes a packaging film 102, an explosive product 106, and the internal detonating cord 104.

The packaging film 102 encases the explosive product 106. The explosive product 106 may have a moldable rheology and not retain its own shape. Thus, the packaging film 102 is used to retain the explosive product 106. As shown, the packaging film 102 may be sufficiently filled with the explosive product 106 such that the packaged explosive 100 is cylindrical due to the perimeter of the packaging film 102.

The amount of the explosive product 106 within the packaging film 102 may affect the overall malleability of the packaged explosive 100. For example, in the illustrated embodiment, the explosive product 106 completely fills the packaging film 102. The explosive product 106 may include an emulsion, a watergel, or other suitable explosive material. As shown, the internal detonating cord 104 is within the explosive product 106.

FIG. 1B illustrates a side view of the packaged explosive 100 with the internal detonating cord 104. As shown, the packaged explosive 100 is divided into a series of chubs 110 forming a string of explosive charges. A chub 110 is formed by filling the packaging film 102 with the explosive product 106. Each chub 110 has the ends sealed by crimps or clips 112.

FIG. 1C illustrates a cross-sectional side view of the packaged explosive 100 with an internal detonating cord 104. In some embodiments, supporting twine may also be included within the packaging film 102. As shown, the internal detonating cord 104 runs the length of the packaged explosive 100. The internal detonating cord 104 is within the packaging film 102 and thus directly in contact with the explosive product 106 and clipped in place with the clips 112.

This direct contact between the internal detonating cord 104 and the explosive product 106 facilitates efficient transfer of energy between the internal detonating cord 104 and the explosive product 106. This may improve sensitivity and reliability of the packaged explosive 100 over an external detonating cord placed on the outside perimeter of a chub (e.g., FIGS. 2A-2B). For example, in extreme cold conditions the internal detonating cord 104 may be able to initiate the explosive product 106 when an external detonating cord placed on the outside perimeter of a chub may not initiate the explosive product 106.

However, the process of clipping the internal detonating cord 104 may be hazardous and wasteful. The packaged explosive 100 may be clipped into individual lengths between the chubs 110 to provide a continuous length of product that can be suspended in a borehole for purposes of pre-break and/or wall control. The optional twine is used to support the weight of the string(s) of charges in a borehole so as to not require the packaged explosive 100 to be supported by the internal detonating cord 104. However, because the internal detonating cord 104 and optional twine is inside the packaging film 102, at least one of the chubs 110 may need to be sacrificed to provide room to tie into the internal detonating cord 104 and optional twine.

Clipping the packaged explosive 100 may damage the detonating cord. For example, during manufacturing, mechanically clipping an internal detonating cord 104 may generate energy sufficient to unintentionally initiate the internal detonating cord 104, creating an extreme risk of injury to personnel and/or property damage. Additionally, if a length of the internal detonating cord 104 is exposed by removing it from the packaging film 102, the length of the internal detonating cord 104 will be contaminated with explosive residue.

Further, accessing the internal detonating cord 104 or the support twine may result in a waste of the explosive product 106. For example, a user may need a length of the internal detonating cord 104 to make connections to the internal detonating cord 104 at the borehole surface. In some situations, the user may need access to the support twine to tie onto supporting structures at the borehole surface. However, during manufacture, the internal detonating cord 104 (and supporting twine if used) is encased in the explosive product 106. To retrieve a length of the internal detonating cord 104 (and twine) a length of the internal detonating cord 104 or twine must have the surrounding explosive material removed, either at the manufacturing location or at the borehole, resulting in both wasted explosive product that must be recycled or otherwise disposed of and a length of internal detonating cord 104 contaminated with explosive residue.

Figure 2A:
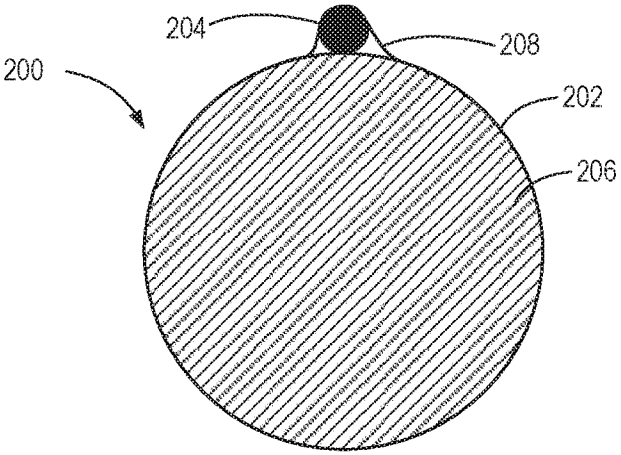
FIG. 2A illustrates a cross-sectional view of a packaged explosive with an external detonating cord.
Figure 2B:
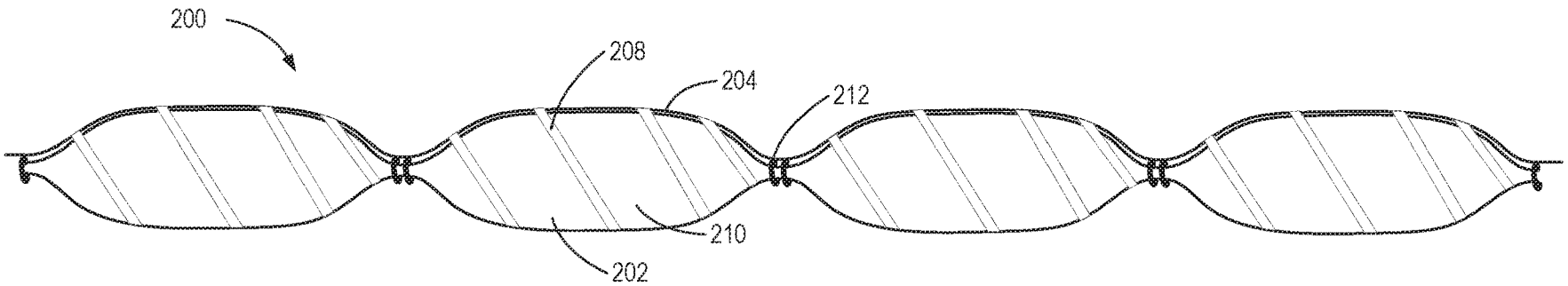
FIG. 2B illustrates a side view of a packaged explosive with an external detonating cord.

FIGS. 2A and 2B illustrate a packaged explosive 200 with an external detonating cord 204. Specifically, FIG. 2A illustrates a cross-sectional view of a packaged explosive 200 with an external detonating cord 204. The packaged explosive 200 includes a packaging film 202, an explosive product 206, and the external detonating cord 204.

The packaging film 202 encases the explosive product 206. The explosive product 206 may have a moldable rheology and not retain its own shape. Thus, the packaging film 202 is used to retain the explosive product 206. As shown, the packaging film 202 may be sufficiently filled with the explosive product 206 such that the packaged explosive 200 is cylindrical due to the shape of the packaging film 202.

The amount of the explosive product 206 within the packaging film 202 may affect the overall malleability of the packaged explosive 200. For example, in the illustrated embodiment, the explosive product 206 completely fills the packaging film 202, limiting the ability to re-shape or bend the packaged explosive 200. The explosive product 206 may include an emulsion, a watergel, or other suitable explosive material.

The external detonating cord 204 (and optionally twine) is secured to the outside perimeter of the packaged explosive 200. Any suitable securement mechanisms may be used to couple the external detonating cord 204 to the exterior side of the packaging film 102. The securement mechanisms may include tape 208, straps, cord, rope, string, and/or twine. In the illustrated embodiment, the tape 208 is used to secure the external detonating cord 204 to the exterior side of the packaging film 202 outside of the explosive product 206.

FIG. 2B illustrates a side view of the packaged explosive 200 with an external detonating cord 204. As shown, the packaged explosive 200 is divided into a series of chubs 210 forming a string of explosive charges. A chub 210 is formed by filling the packaging film 202 with the explosive product 206. Each chub 210 has the ends sealed by crimps or clips 212.

This packaged explosive 200 is constructed by taping the external detonating cord 204 (and optionally twine) to the outside of a string of chubs 210. Specifically, the tape 208 is used to secure the external detonating cord 204 to the exterior side of the packaging film 202 outside of the explosive product 206. As shown, the tape 208 may be a helical strand. In some embodiments, the tape 208 may be several individual pieces placed at intervals along the explosive product 206 coupling the packaging film 202 and the external detonating cord 204.

The packaged explosive 200 may be clipped into individual lengths between the chubs 210 to provide a continuous length of product that can be suspended in a borehole for purposes of pre-break and/or wall control. In some embodiments, the packaged explosive 200 can be a continuous single chub 210 without clips 212 dividing the packaged explosive 200 into shorter lengths. The optional twine is used to support the weight of the string(s) of charges in a borehole so as to not require the packaged explosive 200 to be supported by the external detonating cord 204.

Because the external detonating cord 204 and optional twine are outside of the packaging film 202 and explosive product 206, accessing the external detonating cord 204 may be easier than accessing an internal detonating cord. For example, the packaged explosive 200 can be supplied with extra length of detonating cord (and twine if used) for attaching to initiating elements and/or supporting structures, and the extra length of cord or twine is not contaminated by explosive residue. Even in embodiments where an extra length of detonating cord is not supplied, the external detonating cord 204 and optional twine are exposed and easily accessible to make connections to an initiating cord at a borehole surface or to tie onto supporting structures at the borehole surface. Additionally, because the external detonating cord 204 is not within the explosive product 206, but is attached to the outside of the explosive after the clipping takes place, there is no mechanical clipping event which may create energy sufficient to initiate the external detonating cord 204. Thus, an external detonating cord 204 may be less hazardous and wasteful than an internal detonating cord.

One challenge of using the packaged explosive 200 with the external detonating cord 204 is that much of the initiating energy produced by the external detonating cord 204 is vented externally and is not transferred effectively to initiate the explosive product 206. This can result in a need to use excessively powerful detonating cord to avoid failures, particularly in cold or arctic conditions as the explosive product 206 becomes less sensitive to initiation in those conditions.

Another concern when using the external detonating cord 204 is that untaped or loose sections of the external detonating cord 204 and/or twine may become entangled on rock protrusions or irregularities in the borehole, thereby interfering with placing the string of charges (e.g., packaged explosive 200) properly.

FIGS. 3-7 illustrate embodiments of packaged explosives with an axially-centered external detonating cord. Placing an external detonating cord near the center of a packaged explosive product may improve sensitivity and reliability over an external detonating cord secured to the outside perimeter of the packaged explosive (e.g., FIGS. 2A-2B) while reducing the hazard and waste associated with an internal detonating cord (e.g., FIGS. 1A-1B). In other words, placing an external detonating cord along or near an axis of a packaged explosive may improve the initiation energy transfer between the external detonating cord and the string of explosive product, particularly in extreme cold conditions, while allowing safe manufacture of the string of charges and implementation of the string of charges at the mine site by not exposing the external detonating cord to the actual explosive product.

The embodiments described below resolve the challenges of both internal and external detonating cords. By retaining the detonating cord external to the plastic film of the string of charges, the following embodiments have a detonating cord that is not contaminated by the explosive product and can be manufactured with an extra length of detonating cord for attaching to objects as needed.

The following embodiments also configure and position the charges of the packaged explosive product in such a way that the detonating cord is axially internal to and confined by the mass of explosive product, thereby enabling the initiating energy of the detonating cord to be more fully utilized in initiating the explosive. In some embodiments, chubs of the explosive product may be underfilled and/or arranged in multiples to allow the cord to be positioned towards the axial center of the chub(s) and encased or confined within the packaged explosive. The chub(s) are taped or otherwise secured into a position surrounding the detonating cord, resulting in the benefits of a string of explosive charges with a detonating cord internal to the charges. Thus, the initiating energy of the detonating cord is captured and transferred to the emulsion product better than if the detonating cord were positioned on an exterior side of the packaged explosive.

In the illustrated embodiments, the length of the packaged explosives is divided into a series of chubs with clips forming a string of charges. However, in some embodiments, the packaged explosive may be a single length and not be divided into chubs. Each of the embodiments below may be used with a packaged explosive divided into chubs or with a single length.

Figure 3A:
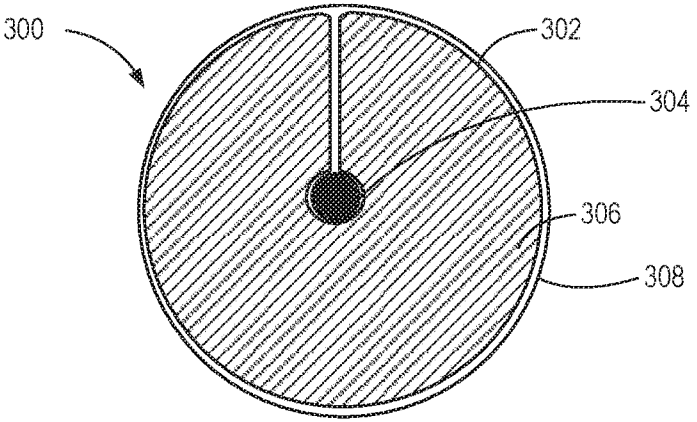
FIG. 3A illustrates a cross-sectional view of a packaged explosive with an axially-centered external detonating cord, according to a first embodiment.
Figure 3B:
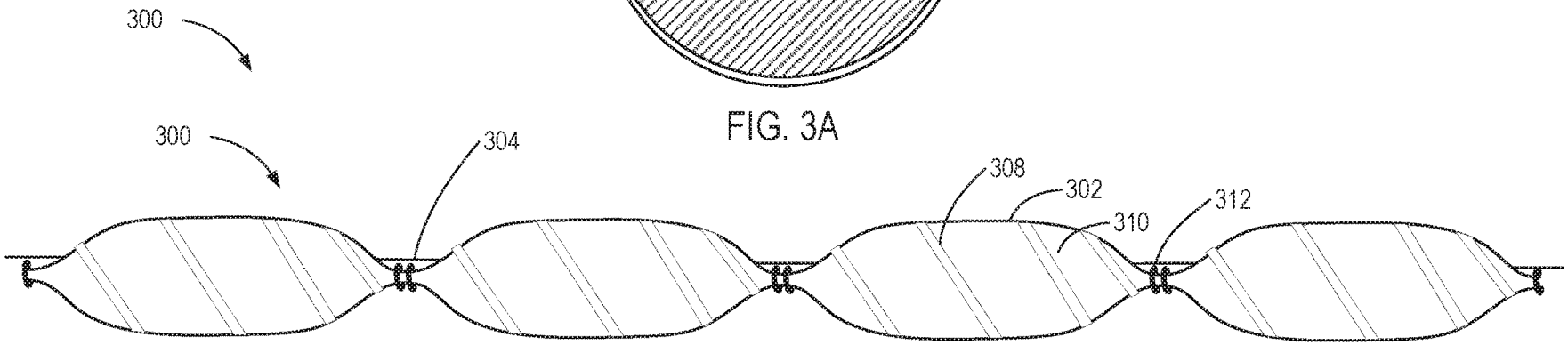
FIG. 3B illustrates a side view of the packaged explosive of FIG. 3A with an axially-centered external detonating cord.
Figure 3C:
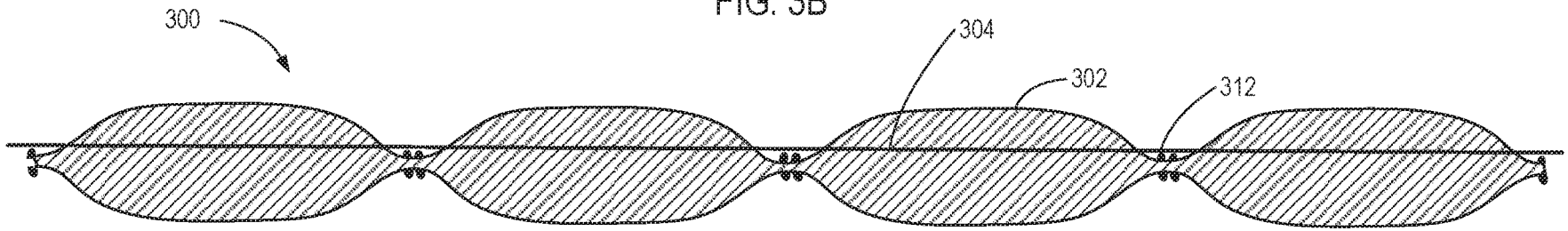
FIG. 3C illustrates a cross-sectional side view of the packaged explosive of FIG. 3A.

FIGS. 3A-3C illustrate a packaged explosive 300 with an axially-centered external detonating cord 304, according to a first embodiment. As illustrated, a packaged explosive 300 with an underfilled packaging film 302 may be folded longitudinally to wrap the axially-centered external detonating cord 304 within the packaged explosive 300 while remaining outside of the explosive product 306.

FIG. 3A illustrates a cross-sectional view of the packaged explosive 300 with the axially-centered external detonating cord 304, according to a first embodiment. The packaged explosive 300 includes a packaging film 302, an explosive product 306, and the axially-centered external detonating cord 304.

The packaging film 302 provides a reservoir or casing for the explosive product 306 to be encased within. The explosive product 306 may be any suitable explosive. For example, the explosive product 306 may be an emulsion, a watergel explosive or any other explosive that has a moldable rheology and does not retain its own shape.

The amount of the explosive product 306 within the packaging film 302 may affect the overall malleability of the packaged explosive 300. Underfilling the packaging film 302 with the explosive product 306 allows the explosive product 306 to retain some of the moldable rheology of the explosive product 306. Thus, the packaging film 302 and the explosive product 306 may be shaped to wrap around the axially-centered external detonating cord 304. As shown, the packaging film 302 and the explosive product 306 may encase the axially-centered external detonating cord 304 and confine the axially-centered external detonating cord 304 to an axially internal position relative to the packaging film 302 and the explosive product 306.

In some embodiments, to obtain the illustrated configuration—the axially-centered external detonating cord 304 external to the packaging film 302 but internal to the mass of the explosive product 306—the explosive product 306 may be packaged in larger diameter packaging film 302 than would normally be used to have a cylindrical explosive charge (e.g., underfilled chub 310), resulting in a limp charge (e.g., underfilled chub 310). As long as the explosive product 306 (e.g., emulsion or watergel) is moldable, then the limp charge can assume many shapes. For example, a limp charge or underfilled chub may include the amount of product typically used for a 45 mm diameter charge and a 2.75" diameter packaging film.

In the illustrated embodiment, the packaging film 302 has enough extra width when lying flat (i.e., before the packaging film 302 is wrapped to form a casing) or finished perimeter length (i.e., perimeter of wrapped casing) to allow the axially-centered external detonating cord 304 to be within the perimeter formed by securing the packaging film 302 but internal to the mass of the explosive product 306 into a cylinder. In some embodiments, the packaged explosive 300 may include excess packaging film 302 for the amount of the explosive product 306 within the casing. In some embodiments, the axially-centered external detonating cord 304 may be pushed into the string of charges (e.g., underfilled chub 310) axially, far enough so that when the charges are subsequently shaped/folded around the detonating cord, the charges are essentially entirely surrounded by emulsion explosive product. In some embodiments, the extra film may be sufficient to allow the axially-centered external detonating cord 304 to be close to the axial center of the charge or the packaged explosive 300 when the charge is shaped into a cylinder.

While in the illustrated embodiment the packaged explosive 300 is shaped into a cylinder, other shapes may be acceptable. Any shape of underfilled chub 310 may be used as long as the shape surrounds or mostly surrounds the axially-centered external detonating cord 304 with the explosive product 306, even though the explosive product 306 remains contained inside the packaging film 302. As shown, the axially-centered external detonating cord 304 is exterior a perimeter of the packaging film 302 but within an exterior perimeter of the packaged explosive 300 as a whole. The axially-centered external detonating cord 304 is axially internal to and confined by the mass of the explosive product 306.

The packaging film 302 and explosive product 306 may be secured in place, encasing the axially-centered external detonating cord 304 (and optionally twine) within the axial center of the packaged explosive 200. Any suitable securement mechanisms may be used to secure the packaging film 302 and explosive product 306 around the axially-centered external detonating cord 304. For example, the securement mechanisms may include tape 308, straps, cord, rope, string, and/or twine. In the illustrated embodiment, the tape 308 is used to secure the packaging film 302 and explosive product 306 in a cylindrical shape. In some embodiments, surfaces of the packaging film 302 that contact each other may be adhered together.

FIG. 3B illustrates a side view of the packaged explosive 300 with the axially-centered external detonating cord 304. As shown, the packaged explosive 300 is divided into a series of underfilled chubs 310 forming a string of explosive charges. An underfilled chub 310 is formed by partially filling the packaging film 302 with the explosive product 306. Each chub 310 has the ends sealed by crimps or clips 312. As shown, in some embodiments, the axially-centered external detonating cord 304 may not be secured by the clips 312. With the axially-centered external detonating cord 304 outside of the clips 312, the axially-centered external detonating cord 304 can be easily accessed.

The packaged explosive 300 may be clipped into individual lengths between the chubs 310 to provide a continuous length of product that can be suspended in a borehole for purposes of pre-break and/or wall control. In some embodiments, the packaged explosive 300 can be a continuous single chub 310 without clips 312 dividing the packaged explosive 300 into shorter lengths. The optional twine is used to support the weight of the string(s) of charges in a borehole so as to not require the packaged explosive 300 to be supported by the axially-centered external detonating cord 304.

The packaged explosive 300 can be supplied with extra length of detonating cord (and twine if used) for attaching to initiating elements and/or supporting structures. Even in embodiments where an extra length of detonating cord is not supplied, the axially-centered external detonating cord 304 and optional twine are exposed where the clips 312 separate the underfilled chubs 310 and are thus easily accessible to make connections to an initiating cord at a borehole surface or to tie onto supporting structures at the borehole surface.

FIG. 3C illustrates a cross-sectional side view of the packaged explosive 300 with the axially-centered external detonating cord 304. In some embodiments, supporting twine may also be included with the axially-centered external detonating cord 304. As shown, the axially-centered external detonating cord 304 is within the charges while being outside of the packaging film 302 relative to the explosive product 306.

The position within the string of charges of the axially-centered external detonating cord 304 may facilitate efficient transfer of energy between the axially-centered external detonating cord 304 and the explosive product 306. This may improve sensitivity and reliability of the packaged explosive 300 over an external detonating cord placed on the outside perimeter of a chub (e.g., FIGS. 2A-2B). For example, in extreme cold conditions the axially-centered external detonating cord 304 encased within the charge may be able to detonate the explosive product 306 when an external detonating cord placed on the outside perimeter of a chub may not detonate the explosive product 306.

Figure 4:
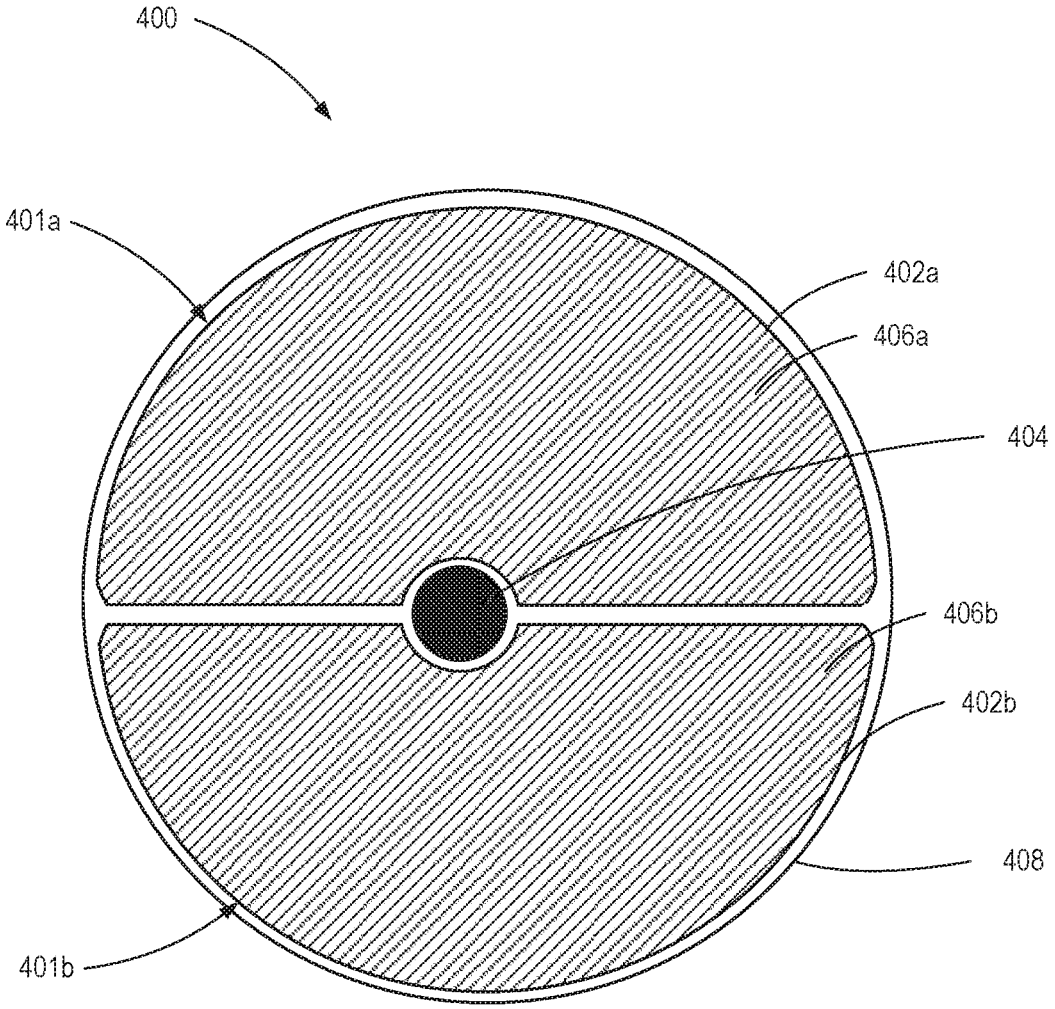
FIG. 4 illustrates a cross-sectional view of a packaged explosive with an axially-centered external detonating cord, according to a second embodiment.

FIG. 4 illustrates a cross-sectional view of a packaged explosive 400 with an axially-centered external detonating cord 404, according to a second embodiment. The packaged explosive 400 includes a first charge 401*a*, a second charge 401*b*, and the axially-centered external detonating cord 404.

The first charge 401*a* comprises a first packaging film 402*a* and a first explosive product 406*a*. The first packaging film 402*a* provides a reservoir or casing for the first explosive product 406*a* to be encased within. The first explosive product 406*a* may be any suitable explosive. For example, the first explosive product 406*a* may be an emulsion, a watergel explosive, or any other explosive that has a moldable rheology and does not retain its own shape.

Similarly, the second charge 401*b* comprises a second packaging film 402*b* and a second explosive product 406*b*. The second packaging film 402*b* provides a reservoir or casing for the second explosive product 406*b* to be encased within. The second explosive product 406*b* may be the same explosive type as the first explosive product 406*a* or a different explosive type.

The first and second packaging films 402*a* and 402*b* may be underfilled with the explosive products 406*a* and 406*b* so that the charge retains some of the moldable properties of the first and the second explosive products 406*a* and 406*b*. Each of the charges 401*a* and 401*b* includes enough excess film that would allow the initiating detonating cord to be secured with a securing mechanism (e.g., tape 408) between the two charges such that the axially-centered external detonating cord 404 is essentially surrounded by the first and the second explosive products 406*a* and 406*b*. In the illustrated embodiment, the first and the second charges 401*a* and 401*b* are formed into half cylinders with the axially-centered external detonating cord 404 in the axial center of the combination of the two charges placed and secured together.

The side view of the packaged explosive 400 may appear similar to the packaged explosive 300 of FIG. 3. For example, the length of the packaged explosives may be divided into a series of chubs with clips forming a string of charges. However, in some embodiments, the packaged explosive may be a single length and not be divided into chubs. Further, the axially-centered external detonating cord 404 may be free of the clips. To further secure the axially-centered external detonating cord 404, the axially-centered external detonating cord 404 can be wrapped outside of one of the strings of explosive charges at each clip location. The packaged explosive 400 can be supplied with extra length of detonating cord (and twine if used) for attaching to initiating elements and/or supporting structures.

Figure 5:
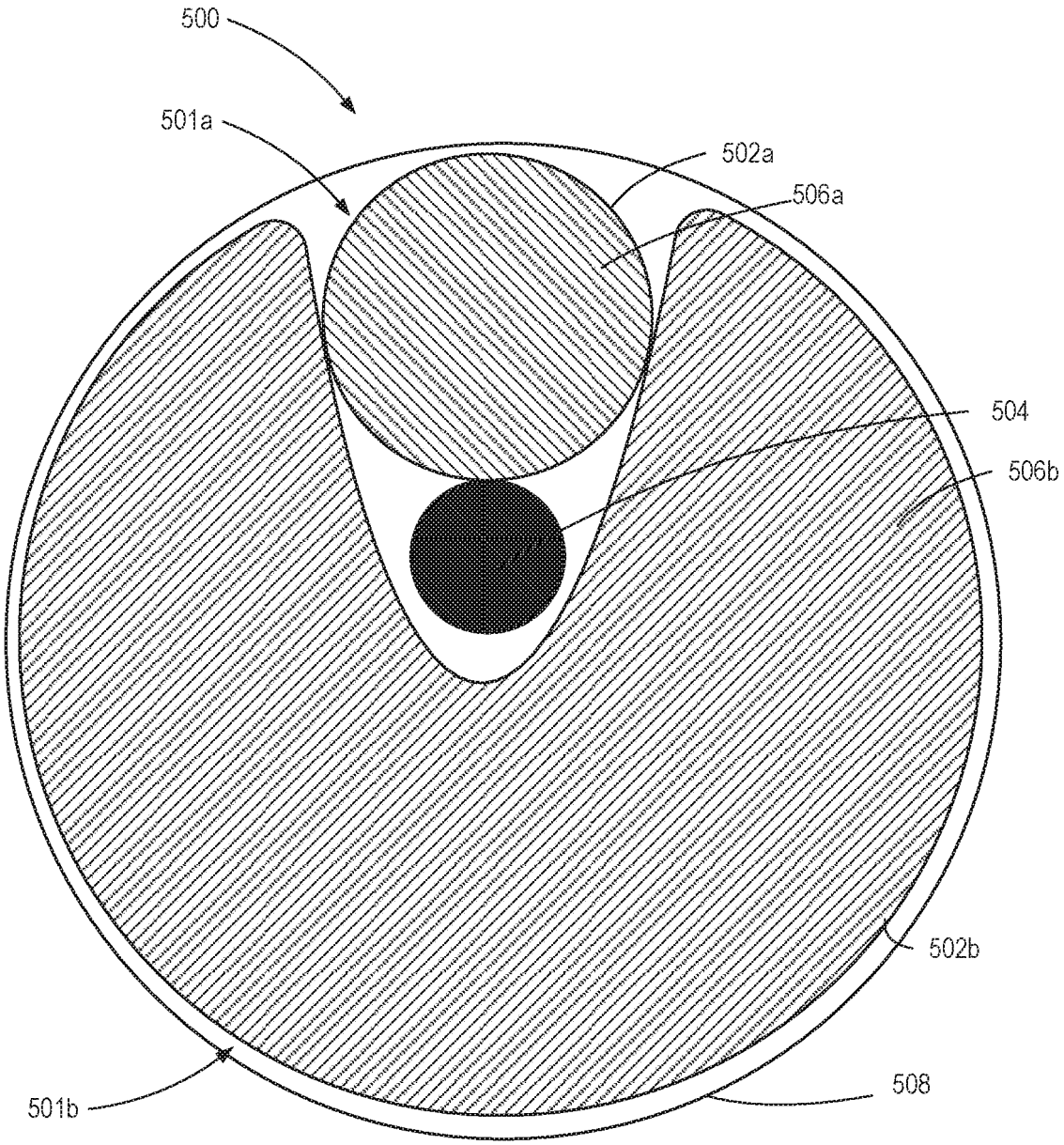
FIG. 5 illustrates a cross-sectional view of a packaged explosive with an axially-centered external detonating cord, according to a third embodiment.

FIG. 5 illustrates a cross-sectional view of a packaged explosive 500 with an axially-centered external detonating cord 504, according to a third embodiment. The packaged explosive 500 includes a first charge 501*a*, a second charge 501*b*, and the axially-centered external detonating cord 504.

The first charge 501*a* comprises a first packaging film 502*a* and a first explosive product 506*a*. The first packaging film 502*a* provides a reservoir or casing for the explosive product to be encased within. The first explosive product 506*a* may be any suitable explosive. For example, the first explosive product 506*a* may be an emulsion, a watergel explosive, or any other explosive that has a moldable rheology and does not retain its own shape.

Similarly, the second charge 501*b* comprises a second packaging film 502*b* and a second explosive product 506*b*. The second packaging film 502*b* provides a reservoir or casing for the explosive product to be encased within. The second explosive product 506*b* may be the same explosive type as the first explosive product 506*a* or a different explosive type. The second explosive product 506*b* may be an emulsion, a watergel explosive, or any other explosive that has a moldable rheology and does not retain its own shape.

As described with reference to FIG. 3, the second packaging film 502*b* may be underfilled with the second explosive product 506*b* so that the charge retains some of the moldable properties of the second explosive product 506*b*. The first packaging film 502*a* may be filled to create a cylindrical charge. As shown, the axially-centered external detonating cord 504 may be confined between the first charge 501*a* and the second charge 501*b*. In some embodiments, the axially-centered external detonating cord 504 may be periodically attached/taped to either the smaller diameter cylindrical first charge 501*a* or to the larger second charge 501*b*.

The first charge 501*a* may be pushed into the second charge 501*b*. In some embodiments, the second charge 501*b* may have equivalent or larger mass of explosive product 506*a* than the first charge 501*a*. The second charge 501*b* may be packaged with extra film to be loose enough to confine the axially-centered external detonating cord 504 between the two charges. To further secure the axially-centered external detonating cord 504, the axially-centered external detonating cord 504 can be wrapped outside of one of the strings of explosive charges at each clip location. The first charge 501*a* and the second charge 501*b* may be secured together with tape 508.

The side view of the packaged explosive 500 may appear similar to the packaged explosive 300 of FIG. 3. For example, the length of the packaged explosives may be divided into a series of chubs with clips forming a string of charges. However, in some embodiments, the packaged explosive may be a single length and not be divided into chubs. Further, the axially-centered external detonating cord 504 may be free of the clips. The packaged explosive 500 can be supplied with extra length of detonating cord (and twine if used) for attaching to initiating elements and/or supporting structures.

Figure 6:
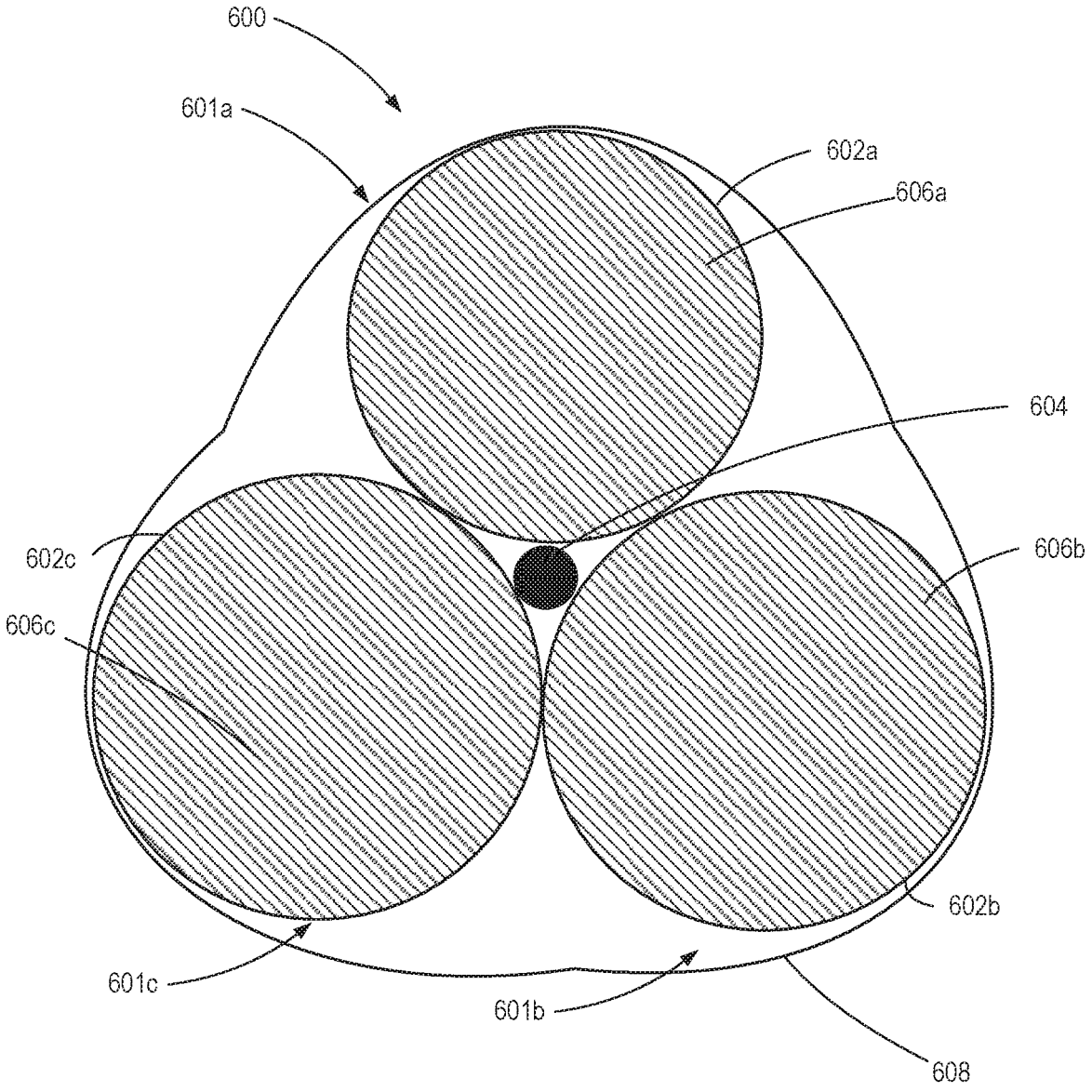
FIG. 6 illustrates a cross-sectional view of a packaged explosive with an axially-centered external detonating cord, according to a fourth embodiment.

FIG. 6 illustrates a cross-sectional view of a packaged explosive 600 with an axially-centered external detonating cord 604, according to a fourth embodiment. The packaged explosive 600 includes a first charge 601*a*, a second charge 601*b*, a third charge 601*c*, and the axially-centered external detonating cord 604. Each of the charges comprises packaging film (i.e., first packaging film 602*a*, second packaging film 602*b*, and third packaging film 602*c*) to provide a casing for the explosive products (i.e., first explosive product 606*a*, second explosive product 606*b*, and third explosive product 606*c*).

As illustrated, in some embodiments the total mass of explosive in the packaged explosive 600 is separated into three separate charges of essentially equivalent diameter. The charges are axially aligned and secured together with the initiating detonating cord central to the three charges. In the illustrated embodiment, the charges are tight cylinders without extra film (i.e., not limp), and tape 608 secures them together.

The side view of the packaged explosive 600 may appear similar to the packaged explosive 300 of FIG. 3. For example, the length of the packaged explosives may be divided into a series of chubs with clips forming a string of charges. However, in some embodiments, the packaged explosive may be a single length and not be divided into chubs. Further, the axially-centered external detonating cord 604 may be free of the clips. To further secure the axially-centered external detonating cord 604, the axially-centered external detonating cord 604 can be spirally or helically wrapped around one of the strings of explosive charges at each clip location. The packaged explosive 600 can be supplied with extra length of detonating cord (and twine if used) for attaching to initiating elements and/or supporting structures.

Figure 7:
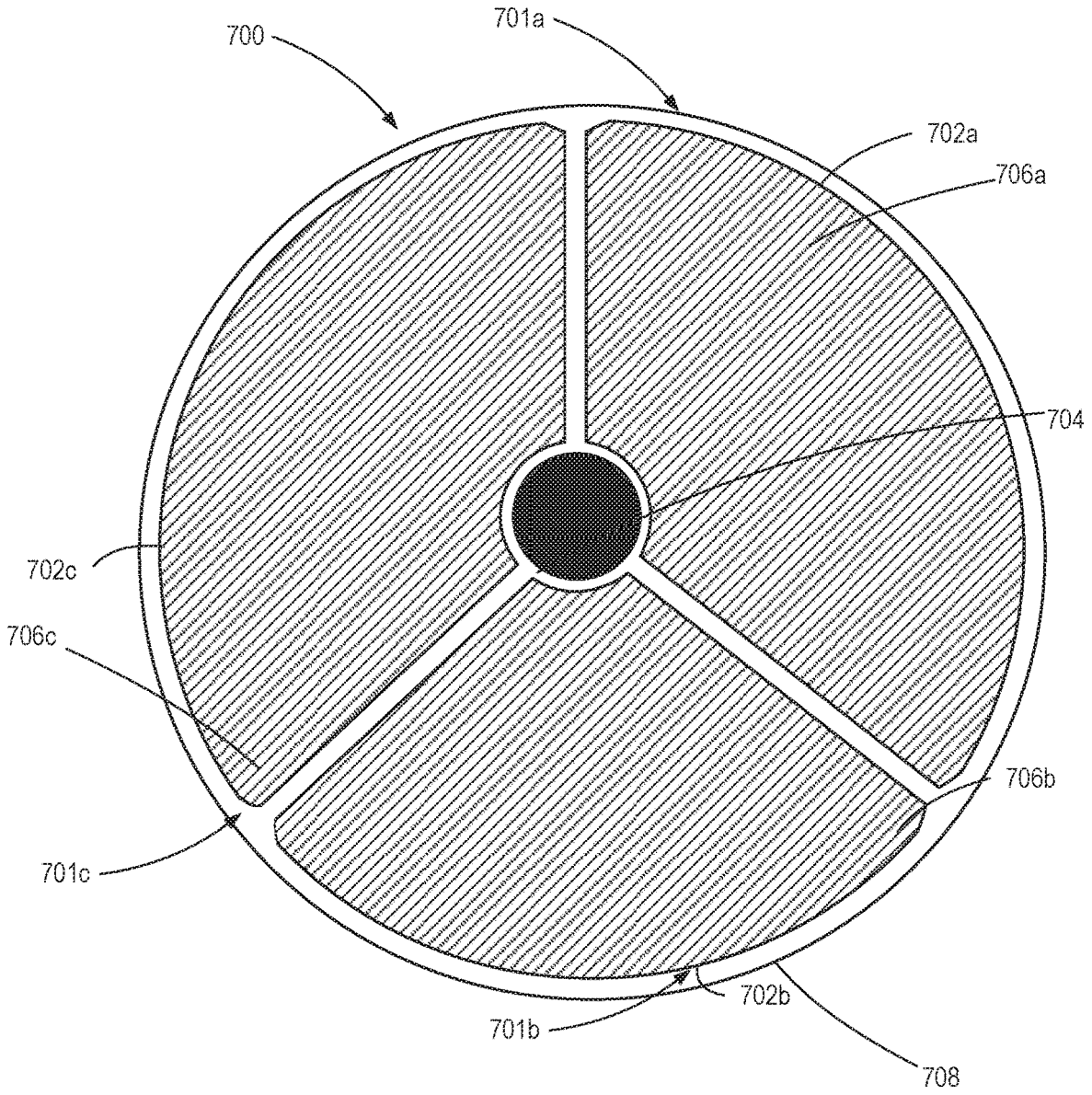
FIG. 7 illustrates a cross-sectional view of a packaged explosive with an axially-centered external detonating cord, according to a fifth embodiment.

FIG. 7 illustrates a cross-sectional view of a packaged explosive 700 with an axially-centered external detonating cord 704, according to a fifth embodiment. The packaged explosive 700 includes a first charge 701*a*, a second charge 701*b*, a third charge 701*c*, and the axially-centered external detonating cord 704. Each of the charges comprises packaging film (i.e., first packaging film 702*a*, second packaging film 702*b*, and third packaging film 702*c*) to provide a casing for the explosive products (i.e., first explosive product 706*a*, second explosive product 706*b*, and third explosive product 706*c*).

As illustrated, in some embodiments the total mass of explosive in the packaged explosive 700 is separated into three separate charges. The charges are axially aligned and secured together with the axially-centered external detonating cord 704 central to the three charges. In the illustrated embodiment, the charges have a small amount of extra film, or are slightly limp, so that when wrapped around and secured with tape 708 to the axially-centered external detonating cord 704, the combined mass can more appropriately resemble a single cylindrical charge as opposed to three individual cylindrical charges.

The side view of the packaged explosive 700 may appear similar to the packaged explosive 300 of FIG. 3. For example, the length of the packaged explosives may be divided into a series of chubs with clips forming a string of charges. However, in some embodiments, the packaged explosive may be a single length and not be divided into chubs. Further, the axially-centered external detonating cord 704 may be free of the clips. To further secure the axially-centered external detonating cord 704, the axially-centered external detonating cord 704 can be wrapped around one of the strings of explosive charges at each clip location. The packaged explosive 700 can be supplied with extra length of detonating cord (and twine if used) for attaching to initiating elements and/or supporting structures.

Figure 8:
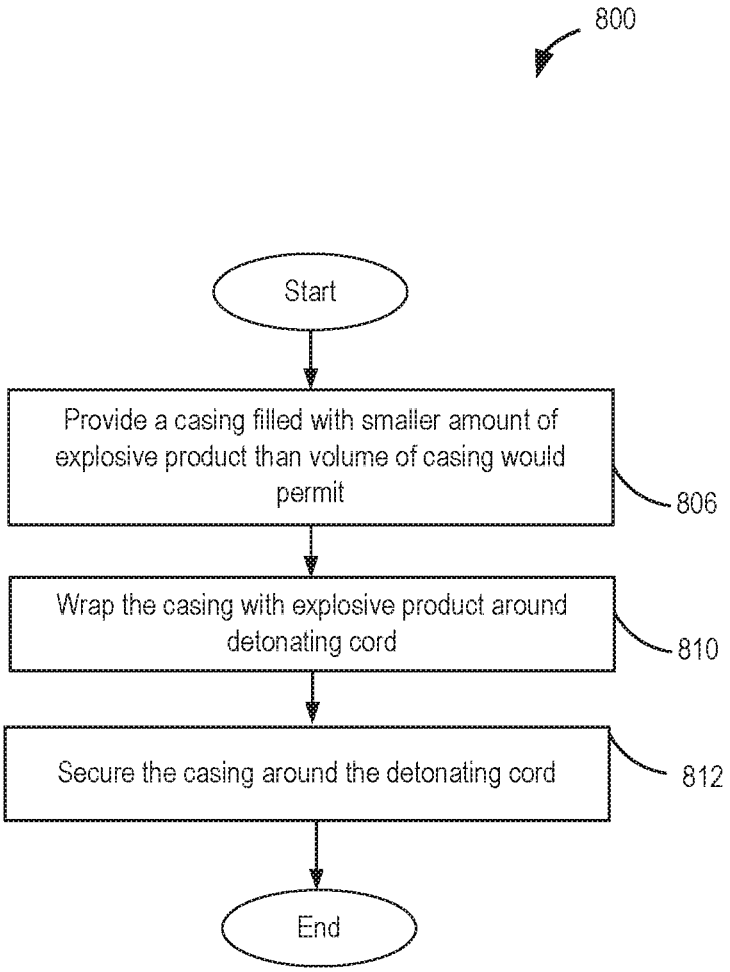
FIG. 8 is a flow chart of a method to manufacture an axially-centered external detonating cord with a single string of explosive charges, according to one embodiment.

FIG. 8 is a flow chart of a method 800 to manufacture an axially-centered external detonating cord with a single string of explosive charges, according to one embodiment. A manufacturer may provide 806 providing an explosive comprising a casing and an explosive product, wherein the casing is filled with an amount of explosive that is less than a volume of the casing would permit.

The manufacturer may wrap 810 the casing filled with the explosive product around at least a portion of a detonating cord, and secure 812 the casing around the detonating cord. In some embodiments, the detonating cord is located near the central axis along a length of the casing as wrapped. For example, the casing filled with explosive product may form a cylinder when wrapped and the detonating cord may pass through close to the central axis of the cylinder. In some embodiments, wrapping 810 the casing around the detonating cord comprises folding the casing filled with the explosive product, and pushing the detonating cord into a fold of the casing filled with the explosive product. In some embodiments, the detonating cord is not clipped with the casing. In some embodiments, the casing and explosive product may be formed into a string of explosive charges separated by the clips.

Figure 9:
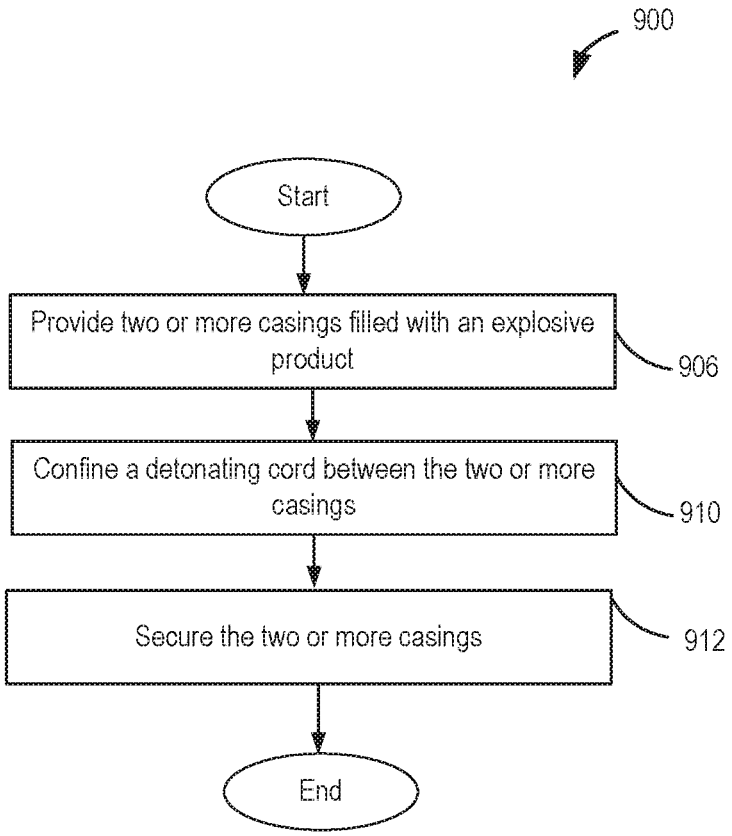
FIG. 9 is a flow chart of a method to manufacture an axially-centered external detonating cord with multiple strings of explosive charges, according to one embodiment.

In some embodiments, additional steps to the method 800 may include forming a casing with packaging film and clip 804 a first portion of the casing. The manufacturer may fill the casing with an explosive product. In some embodiments, the casing is filled with an amount of explosive that is less than a volume of the casing would permit. The manufacturer may clip a second portion of the casing to seal the explosive product within the casing. In some embodiments, the method 800 may further comprise wrapping the detonating cord around at least of one of the two or more casings at the first portion and the second portion FIG. 9 is a flow chart of a method 900 to manufacture an axially-centered external detonating cord with multiple strings of explosive charges, according to one embodiment. The manufacturer may provide 906 two or more casings filled with an explosive product. The manufacturer may confine 910 at least a portion of a detonating cord between the two or more casings, and secure 912 the two or more casings to each other to form a combined charge. The detonating cord may be located near the central axis along a length of the combined charge.

In some embodiments, at least one of the two or more casings is filled with an amount of explosive that is less than a volume of the casing would permit. In some embodiments, at least one of the casings may be underfilled and at least one of the casings is filled with an amount of explosive that causes the at least one of the two or more casings to form a cylindrical charge. In some embodiments, the combined charge is cylindrical. In some embodiments, each of the two or more casings is filled with an amount of explosive to form a cylindrical charge. In some embodiments, the method 900 may further comprise wrapping the detonating cord around at least of one of the two or more casings where the casings are clipped. In some embodiments, the detonating cord is not clipped with the casing. In some embodiments, the casings and the explosive product may be formed into a series of combined charges separated by the clips, the series of combined charges having multiple strings of charges.

In some embodiments, the manufacturer using this method 900 may form two or more casings with packaging film, and clip a first portion of each of the two or more casings with one or more clips. The manufacturer may fill the two or more casings with an explosive product, and clip 908 a second portion of each of the two or more casings to seal the explosive product within the two or more casings.

One of ordinary skill in the art, with the benefit of this disclosure, would understand that the systems and methods disclosed herein may also include other components and method steps. For example, while the illustrated embodiments show up to three charges surrounding a detonating cord, additional charges may be used.

The examples and embodiments disclosed herein are to be construed as merely illustrative and exemplary and not a limitation of the scope of the present disclosure in any way. It will be apparent to those having skill in the art, and having the benefit of this disclosure, that changes may be made to the details of the above-described embodiments without departing from the underlying principles of the disclosure herein.

The invention claimed is:

1. A packaged explosive product comprising:

packaging film forming one or more casings;

explosive product contained within the one or more casings, the explosive product and the one or more casings forming one or more charges;

a detonating cord, wherein the detonating cord is positioned external the one or more casings in relation to the explosive product, and wherein the detonating cord is positioned axially internal in relation to the explosive product of the one or more charges, the packing film of the one or more charges preventing physical contact with the explosive product surrounding the detonating cord, clips to separate the one or more charges into a series of charges, wherein the detonating cord extends along the series of charges outside of the clips.

2. The packaged explosive product of claim 1, wherein the one or more casings comprises a first casing, and wherein the first casing is underfilled with explosive product to form a first charge that is moldable.

3. The packaged explosive product of claim 2, wherein the first charge is wrapped around the detonating cord.

4. The packaged explosive product of claim 2, wherein the one or more casings comprises a second casing, and wherein the second casing is underfilled with explosive product to form a second charge that is moldable, wherein the first charge and the second charge are secured together to from a cylinder, wherein the first charge and the second charge are hemispheres of the cylinder with the detonating cord between the first charge and the second charge.

5. The packaged explosive product of claim 2, wherein the one or more casings comprises a second casing, and wherein the second casing is filled with explosive product to form a second charge that is a cylinder.

6. The packaged explosive product of claim 5, wherein the detonating cord is secured to the second charge and at least a portion of the detonating cord is confined between the first charge and the second charge.

7. The packaged explosive product of claim 2, wherein the one or more casings comprises a second casing and a third casing, and wherein the second casing and the third casing are underfilled with explosive product to form a second charge and a third charge that are moldable, wherein the first charge, the second charge, and the third charge are secured together to from a cylinder with the detonating cord inside the cylinder.

8. The packaged explosive product of claim 2, wherein the one or more casings comprises at least three casings filled to form at least three cylindrical charges, and wherein the at least three cylindrical charges are secured with the detonating cord between the at least three cylindrical charges.

9. A method of manufacturing a packaged explosive, the method comprising:

forming a casing with packaging film;

clipping a first portion of the casing;

filling the casing with an explosive product, wherein the casing is filled with an amount of explosive that is less than a volume of the casing would permit;

clipping a second portion of the casing to seal the explosive product within the casing; and wrapping the casing filled with the explosive product around at least a portion of a detonating cord.

10. The method of claim 9, wherein the detonating cord is located near an axis along a length of the casing as wrapped.

11. The method of claim 9, wherein wrapping the casing around the detonating cord comprises:

folding the casing filled with the explosive product; and pushing the detonating cord into a fold of the casing filled with the explosive product.

12. The method of claim 9, wherein the detonating cord is not clipped with the casing.

13. The method of claim 9, further comprising securing the casing around at least the portion of the detonating cord.

14. A method of manufacturing a packaged explosive, the method comprising:

providing one or more explosive chubs each comprising a packaging film encasing an explosive product;

surrounding at least a portion of a detonating cord with the one or more explosive chubs; and securing the one or more explosive chubs around the detonating cord such that at least the portion the detonating cord is confined within a position that is axially internal in relation to the explosive product of the one or more explosive chubs while the packing film prevents physical contact between the explosive product and the detonating cord, wherein a portion of the detonating cord is exposed between adjacent chubs.

15. The method of claim 14, wherein the one or more chubs comprise at least two chubs, and surrounding at least the portion of the detonating cord comprises confining at least the portion of the detonating cord between the at least two chubs.

16. The method of claim 15, wherein at least one of the at least two chubs is filled with an amount of explosive that is less than a volume of the packaging film would permit.

17. The method of claim 16, wherein one or more of the at least two chubs is filled with an amount of explosive that causes the at least one or more of the at least two chubs to form a cylindrical charge.

18. The method of claim 16, wherein a combined charge comprising the at least two chubs is cylindrical.

19. The method of claim 15, wherein each of the at least two chubs is filled with an amount of explosive that causes each of the at least two chubs to form a cylindrical charge.

20. The method of claim 15, wherein the detonating cord is located near an axis along a length of a combined charge.

21. The method of claim 15, further comprising securing the at least two chubs to each other to form a combined charge.

* * * * *